US007569760B2

(12) United States Patent
Vochezer

(10) Patent No.: US 7,569,760 B2
(45) Date of Patent: Aug. 4, 2009

(54) PEG CUTTER

(75) Inventor: Georg Vochezer, Argenbuehl-Christazhofen (DE)

(73) Assignee: Wittner GmbH & Co. KG, Isny (DE)

( * ) Notice: Subject to any disclaimer, the term of this patent is extended or adjusted under 35 U.S.C. 154(b) by 68 days.

(21) Appl. No.: 11/715,656

(22) Filed: Mar. 7, 2007

(65) Prior Publication Data

US 2007/0214938 A1 Sep. 20, 2007

(30) Foreign Application Priority Data

Mar. 14, 2006 (DE) ..... 10 2006 013 437

(51) Int. Cl.
*G10G 7/00* (2006.01)

(52) U.S. Cl. ..... 84/458; 84/274; 84/305; 144/12

(58) Field of Classification Search ..... 84/274, 84/458, 305; 144/12
See application file for complete search history.

(56) References Cited

U.S. PATENT DOCUMENTS

| | | | | | |
|---|---|---|---|---|---|
| 6,659 | A | * | 8/1849 | Kirby | 144/156 |
| 14,173 | A | * | 1/1856 | Webber | 142/48 |
| 60,985 | A | * | 1/1867 | Young | 30/495 |
| 68,064 | A | * | 8/1867 | Giford | 82/157 |
| 220,442 | A | * | 10/1879 | Stearns | 30/495 |
| 297,865 | A | * | 4/1884 | Snee | 144/12 |
| 353,761 | A | * | 12/1886 | Rush | 144/28.72 |
| 617,441 | A | * | 1/1899 | Kelly | 30/495 |
| 711,396 | A | * | 10/1902 | Gregg | 84/305 |
| 1,029,503 | A | * | 6/1912 | Lumello | 144/12 |
| 1,328,824 | A | * | 1/1920 | Dorrell | 84/305 |
| 1,345,972 | A | * | 7/1920 | Strough | 84/305 |
| 1,479,921 | A | * | 1/1924 | Miller | 30/457 |
| 1,520,338 | A | * | 12/1924 | Dornseif | 30/457 |
| 2,764,187 | A | * | 9/1956 | Zemrowski | 142/56 |
| 3,111,971 | A | * | 11/1963 | Spencer | 144/30 |
| 3,118,476 | A | * | 1/1964 | Fiore | 144/30 |
| 3,478,636 | A | * | 11/1969 | Juzek | 84/305 |
| 4,497,352 | A | * | 2/1985 | Lippolt | 142/48 |

(Continued)

FOREIGN PATENT DOCUMENTS

| | | | |
|---|---|---|---|
| DE | 296 21 459 | | 2/1997 |
| DE | 202 08 025 | | 9/2002 |
| GB | 189319457 | A * | 8/1894 |

OTHER PUBLICATIONS

How to Install New Pegs, viewed Aug. 21, 2008 at hmi.homewood.net/pegjob.*

(Continued)

*Primary Examiner*—Jeffrey Donels
*Assistant Examiner*—Robert W Horn
(74) *Attorney, Agent, or Firm*—Lipsitz & McAllister LLC

(57) ABSTRACT

A peg cutter for the peg elements of stringed musical instruments, comprising a cutting-object receptacle, a blade with at least one cutting edge the position of which relative to the cutting-object receptacle is adjustable, and at least one contact element for the blade for defining the position of the at least one cutting edge relative to the cutting-object receptacle, wherein the cutting-object receptacle and the at least one contact element are formed in such a way that the at least one cutting edge lies on the envelope of a cone when the blade rests on the at least one contact element.

24 Claims, 8 Drawing Sheets

U.S. PATENT DOCUMENTS

| | | | | |
|---|---|---|---|---|
| 4,798,503 | A * | 1/1989 | Huju | 408/211 |
| 5,401,125 | A * | 3/1995 | Sevack et al. | 408/203.5 |
| 5,503,200 | A * | 4/1996 | Lea | 142/38 |
| 5,638,877 | A * | 6/1997 | April | 144/30 |
| 5,774,995 | A * | 7/1998 | Ross | 30/454 |
| 6,263,929 | B1 * | 7/2001 | Aziz et al. | 142/31 |
| 6,599,065 | B2 * | 7/2003 | Haughton et al. | 408/203.5 |
| 6,732,437 | B2 * | 5/2004 | Eisen et al. | 30/461 |
| 6,976,314 | B2 * | 12/2005 | Luttgens | 30/457 |
| 7,225,547 | B2 * | 6/2007 | Luttgens | 30/457 |
| 7,363,714 | B2 * | 4/2008 | Luttgens | 30/452 |
| 2007/0214938 | A1 * | 9/2007 | Vochezer | 84/458 |
| 2008/0000094 | A1 * | 1/2008 | Tong | 30/457 |
| 2009/0025528 | A1 * | 1/2009 | Vochezer | 84/304 |

OTHER PUBLICATIONS

Tools for the Luthier, International Luthier's Supply, viewed Jun. 23, 2008 at www.internationalluthiers.com.php, includes peg shavers.*
Peg Shavers, Metropolitan Music Company, viewed Jun. 23, 2008 showing Juzek and Herdim Pag Shavers/Shapers at www.metmusic.com/store/intex.html?action=browse&CategoryNum=22.*
Violin Making Tools, Herdim, Luscombe Violins, updated Aug. 17, 2007, viewed 6/23/20008 at www.violins.on.ca/tools3.html.*
Photographs of prior art peg cutters, dates unknown.

* cited by examiner

PEG CUTTER

The present disclosure relates to the subject matter disclosed in German application number 10 2006 013 437.0 of Mar. 14, 2006, which is incorporated herein by reference in its entirety and for all purposes.

BACKGROUND OF THE INVENTION

The invention relates to a peg cutter for the peg elements of stringed musical instruments.

The strings of a stringed musical instrument such as a violin, a viola or a cello for example are held on the peg box by means of peg elements. The peg box comprises conical borings for this purpose. A peg element must be matched to the corresponding conical boring in the peg box in order to be properly seated on the peg box. This is done by means of a peg cutter or peg parer.

SUMMARY OF THE INVENTION

In accordance with the present invention, a peg cutter is provided that is universally applicable.

In accordance with an embodiment of the present invention, the peg cutter comprises a cutting-object receptacle, comprises a blade (cutter) having at least one cutting edge whose position relative to the cutting-object receptacle is adjustable, and comprises at least one contact element for the blade for defining the position of the at least one cutting edge relative to the cutting-object receptacle, wherein the cutting-object receptacle and the at least one contact element are formed in such a way that the at least one cutting edge lies on the envelope of a cone when the blade is placed on the at least one contact element.

With the aid of the peg cutter in accordance with the invention, the blade can be brought in a simple manner into a position such that the cutting edge lies on the envelope of a cone (the cone's envelope). It is thereby ensured that an accurate cone (actually, a section of a cone) is set for the particular part of the peg element that is to be cut.

Due to the adjustability of the blade, different peg element geometries can be processed. In particular, it is possible to set the thickness of the paring. Thus, in principle, peg elements of any type can be cut and all manner of peg element cones can be produced by the peg cutter.

In accordance with the present invention, it can be ensured that the positioning of the cutting edge relative to the peg element that is to be cut is always the same, irrespective as to how much of the diameter of the peg element has already been pared off, or, which sleeves are used when sleeves incorporating sleeve cutting-object receptacles and serving for holding peg elements are inserted into the cutting-object receptacle. The rake angle (the angle between the cutter and the paring during the paring process) and the clearance angle (the angle between the cutter and the peg element after the paring process) do not change and the preselected, closely set thickness of the paring also does not change. Peg elements even with different cone sizes can thereby be worked using the same peg cutter in accordance with the invention.

It is advantageous if the at least one cutting edge is adapted to be positioned on a generatrix of the envelope of a cone. A cone can thus be pared with great accuracy.

It is expedient, if the amount by which the at least one cutting edge projects into the cutting-object receptacle is adjustable. The thickness of the paring can thereby be set. In particular, it can be set with a high degree of accuracy.

It is expedient, if the thickness of the paring is adjustable in a range of hundredths of a millimeter. One thereby attains a high level of accuracy for a correspondingly pared peg element. This in turn can thereby ensure a good seat on the peg box.

It is particularly very advantageous, if the at least one contact element is in the form of a slider. The position of the blade can thereby be set in a simple manner by appropriate positioning of the contact element. Furthermore, it can be ensured in a simple manner that a cutting edge lies on the envelope of a cone.

In particular, the at least one contact element is displaceable on a guide rail. In this way, the position of the cutter can be set in a simple and accurate manner.

Preferably, the position of the at least one cutting edge relative to the cutting-object receptacle is determined by the position of the at least one contact element on the guide rail when the blade rests on the at least one contact element. The position of the cutting edge and thus the thickness of the paring for example can thereby be set in a simple manner by means of the at least one contact element.

It is particularly advantageous, if a first contact element and a second contact element are displaceable on the guide rail. A process for accurately aligning the blade can thus be obtained in a simple manner. In particular, it can be aligned with great accuracy such that the cutting edge lies on the envelope of a cone.

It is expedient then, if the first contact element and the second contact element are arranged to be mutually mirror-symmetrical at least in respect of their bearing surfaces for the blade. Accurate setting of the alignment of the cutting edge can then be achieved in a simple manner by means of a corresponding mirror-symmetrical positioning process.

It is expedient, if the at least one contact element is displaceable in a direction which is substantially parallel to a generatrix of the envelope of a cone. Accurate alignment of the effective cutting edge on the envelope of a cone can thereby be obtained in a simple manner whereby, for example, the thickness of the paring is adjustable.

It is then expedient, if the at least one contact element comprises a bearing surface for the cutter which has a varying spacing in a direction transverse to the guide rail. In dependence upon the position of the at least one contact element on the guide rail, the amount by which a cutting edge projects beyond an edge bounding the cutting-object receptacle can then be set. In turn, the thickness of the paring can thereby be adjusted. Furthermore, it is thereby possible to produce an accurate cone in a simple manner even for differing geometries of the peg elements.

In particular, the at least one contact element tapers monotonically in one direction. Thus, for example, the thickness of the paring can be set in a simple manner by means of the position of the at least one contact element.

It is expedient, if, at its contact surface, the at least one contact element is wedge-shaped. On the one hand thereby, accurate alignment and adjustment of the blade can be ensured. But on the other hand, the area of the contact surface can be minimized so that the at least one contact element can be removed after the adjustment process has been completed in order not to interfere with a cutting or paring process.

It is particularly very advantageous, if the at least one blade is bevelled with respect to the cutting edge by means of a inclined surface. It can thereby be ensured that the cutting edge will not touch the contact element when the blade is placed on the at least one locating element.

In particular, the at least one contact element is formed in such a way that the inclined surface is adapted to be placed thereon beyond the cutting edge.

It is expedient, if the cutting-object receptacle comprises an opening towards the at least one contact element in which the blade is displaceable. The cutting edge can be effective on the peg element that is to be cut through this opening.

It is particularly very advantageous, if the opening lies on the envelope of a cone. It can thereby be ensured that the cutting edge is adapted to be positioned on the envelope of the cone.

It is expedient, if the cutting-object receptacle is formed in such a way that an object requiring cutting is adapted to be accommodated therein such that the orientation of the cutting-object is such that a surface of the cone lies on the opening. An accurate cone for the cut peg element can thereby be obtained in a simple manner.

If a cross section of the cutting-object receptacle tapers towards one end, then an accurate cone can be obtained in a simple manner. Furthermore, the cutting-object receptacle can then also be used for the positioning of sleeves or bushings which can themselves accommodate an object requiring cutting. Due to the tapering of the cross section, fixing of such a sleeve or bushing in the longitudinal direction can be achieved.

In particular, the cutting-object receptacle is in the form of a hollow truncated cone. A peg element of corresponding size with an accurate cone can thereby be produced in accord with the dimensions of the cutting-object receptacle. Furthermore, the cutting-object receptacle can accommodate suitable sleeves.

In one embodiment, provision is made for there to be one or more sleeves for the cutting-object receptacle and that they themselves comprise a sleeve cutting-object receptacle. Peg elements can be positioned in the sleeves. The sleeves can, in turn, be matched to the corresponding geometries of the peg elements. In principle, every possible type of peg element cone geometry can thereby be produced using the same peg cutter due to the provision of appropriate sleeves.

It is particularly very advantageous, if the sleeve or sleeves are fixable in the cutting-object receptacle in non-rotatable manner. A cutting process on a peg element which is arranged in a sleeve cutting-object receptacle can thus be carried out in a simple manner.

In particular, a sleeve cutting-object receptacle is formed as a hollow truncated cone. The corresponding envelope of the cone is that envelope of the cone upon which the cutting edge lies. An accurate cone for a peg element can thereby be produced.

It is expedient, if a sleeve cutting-object receptacle comprises an opening towards the at least one locating element. The cutting edge can be effective on the peg element which is seated in the sleeve cutting-object receptacle through this opening.

In particular, the opening lies on the envelope of a cone when the corresponding sleeve is positioned in the cutting-object receptacle.

It is particularly very advantageous, if there is provided a set of sleeves whose sleeve cutting-object receptacles are matched to the usual dimensions of a peg element. A predetermined peg element cone geometry can thereby be set using the same peg cutter by appropriate choice of a sleeve.

In particular, an axis of the cone, which forms the envelope of the cone, is inclined to the cutting edge by the cone angle when the cutting edge is in its adjusted state. It can thereby be ensured in a simple manner that the effective cutting edge is on the envelope of a cone and lies, in particular, on a generatrix of the envelope of the cone.

In one embodiment, provision is made for the at least one contact element to be displaceable perpendicularly to a generatrix of the envelope of the cone. If a contact surface of the contact element is aligned in parallel with a generatrix of the envelope of a cone, then the effect is achieved that the cutting edge lies on the envelope of the cone. The thickness of the paring can then be set by means of a displacement in a direction perpendicular to the generatrix.

The following description of preferred embodiments taken in conjunction with the drawings serves for a more detailed explanation of the invention.

DETAILED DESCRIPTION OF THE INVENTION

The strings of a stringed musical instrument such as a violin, a viola or a cello for example are held on the peg box by means of peg elements. The peg box comprises borings which are usually rotationally symmetrical for the purpose of fixing the peg elements. These borings are conical and have a small cone angle which is in the order of magnitude of 2° for example. In correspondence therewith, the peg elements comprise a conical fixing part.

Peg cutters are provided for matching the peg elements to the borings in a peg box.

Figure 5:
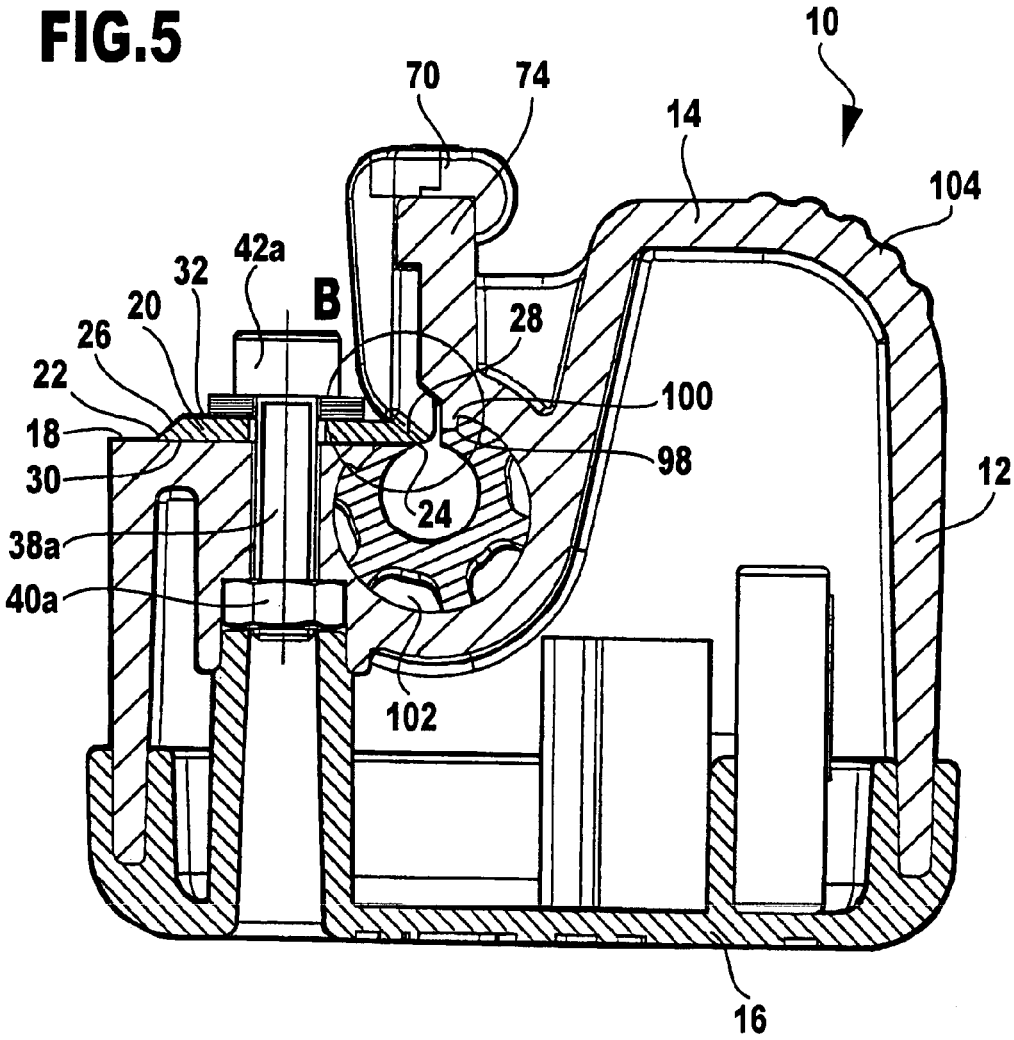
FIG. 5 a sectional view along the line 5-5 in accordance with FIG. 1.
Figure 6:
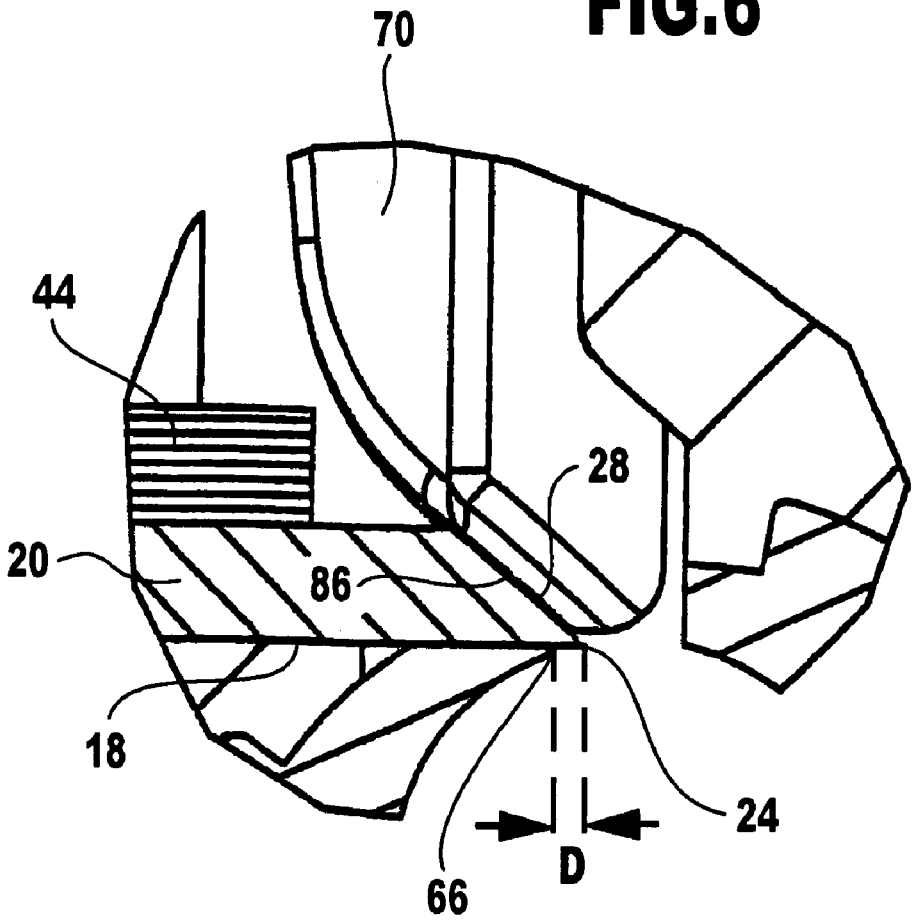
FIG. 6 an enlarged view of the region B in accordance with FIG. 5.

An exemplary embodiment of a peg cutter in accordance with the invention which is shown in FIGS. 1 to 7 and bears the general reference 10 therein comprises a housing 12. The housing 12 can be of single or multipart form. In the exemplary embodiment shown, the housing 12 comprises an upper housing part 14 and a lower housing part 16 which are fixed together (FIG. 5).

The upper housing part 14 comprises a flat contact surface 18 having a blade 20 resting thereon. The blade 20 comprises a first cutting edge 22 and a parallel second cutting edge 24 located opposite thereto. The blade 20 is bevelled with respect to the first cutting edge 22 and the second cutting edge 24 by means of the respective bevelled surfaces 26, 28. The blade 20 comprises a substantially flat lower surface 30 with which it rests on the contact surface 18, and it comprises a substantially flat upper surface 32 which is parallel to the lower surface 30.

Figure 7:
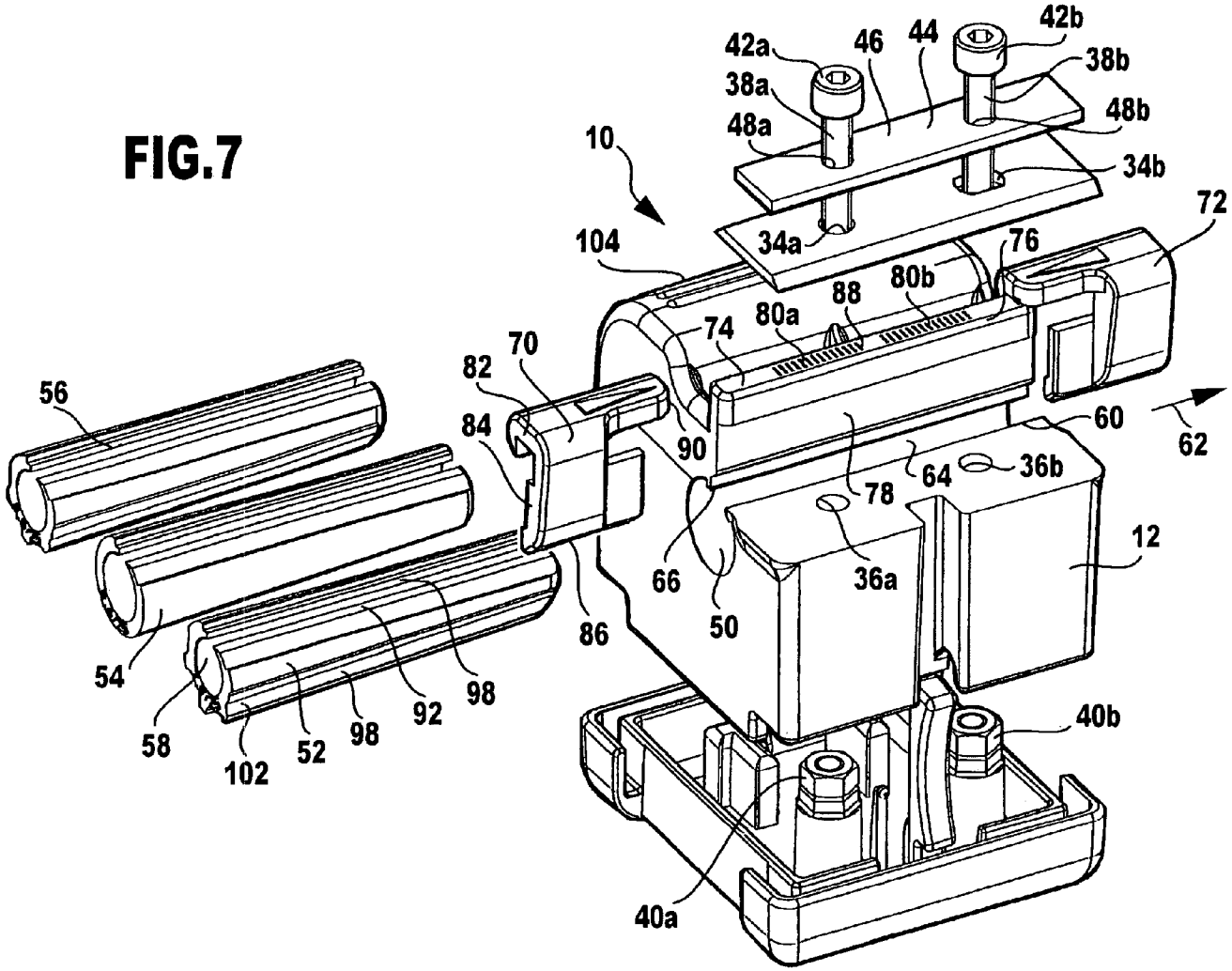
FIG. 7 an exploded view of the peg cutter in accordance with FIG. 1.

The blade 20 has a first through opening 34*a* and a second through opening 34*b* (FIG. 7). Through openings 36*a*, 36*b* which extend from the bearing surface 18 are likewise arranged in the upper housing part 14, these openings being spaced from one another by the same amount as the openings 34*a*, 34*b*. A first pin element 38*a* which is provided with a thread at the lower end thereof is fed through the openings 34*a* and 36*a*. A first nut element 40*a* into which the threaded region of the first pin element 38*a* is inserted is arranged in non-rotatable manner on the lower housing part 16. The first pin element 38*a* is provided with a first retaining head 42*a* by means of which the blade 20 is adapted to be pressed against the bearing surface 18 in order to enable it to be fixed relative to the contact surface 18.

A second pin element 38*b* which is likewise provided with a thread at its lower end extends through the openings 34*b* and 36*b*. This thread is fed into a second nut element 40*b* which is likewise arranged in non-rotatable manner on the lower housing part 16. The second pin element 38*b* has a retaining head 42*b*.

The blade 20 incorporating the first cutting edge 22 and the second cutting edge 24 is in the form of a reversible blade (turning cutter). When a cutting edge no longer cuts properly because of wear and tear, then, after releasing the pin elements 38*a*, 38*b* from the respective nut elements 40*a*, 40*b*, the blade 20 can be turned round in order to bring the other cutting edge into the effective region.

A pressure strip 44 is positioned between the retaining heads 42*a* and 42*b*. This pressure strip rests on the upper surface 32 of the cutter 20. The retaining heads 42*a*, 42*b*, in turn, exert a direct pressure on an upper surface 46 of the pressure strip. The pressure strip 44 is likewise provided with openings 48*a*, 48*b* through which the respective pin elements 38*a* and 38*b* extend.

The dimensions of the openings 34*a*, 34*b* in the blade 20 are such that when the pin elements 38*a*, 38*b* are released (i.e. when the retaining heads 42*a*, 42*b* are not producing any effective pressure on the blade 20 or when the pressure exerted is so low that the blade 20 is displaceable relative to the retaining heads 42*a*, 42*b*), it is possible to produce a relative degree of movement between the blade 20 and the pin elements 38*a*, 38*b* that are fixed to the nut elements 40*a* and 40*b* in order to enable the position of the blade 20 relative to a cutting-object receptacle 50 to be adjusted to a certain extent.

The openings 48*a*, 48*b* in the pressure strip 44 are preferably matched to the pin elements 38*a*, 38*b* in such a way that no especial transverse degree of movement between the pin elements 38*a*, 38*b* and the pressure strip 44 is permitted.

Washers rather than a pressure strip could also be provided particularly in the case of thicker blades.

The cutting-object receptacle 50 serves directly for accommodating an object requiring cutting in the form of a peg element that is to be cut, or, for accommodating a sleeve or bushing 52, 54, 56, whereby in turn, the sleeves 52, 54, 56 themselves each comprise a sleeve cutting-object receptacle 58 in which peg elements are adapted to be positioned. Peg elements of different cone angles and/or having bases of different cross-sectional area can be processed by the peg cutter 10 with the aid of such sleeves 52, 54, 56.

The bearing surface 18 has a substantially straight edge 60 where it adjoins the cutting-object receptacle 50. The cutting-object receptacle 50 has a conical shape (in the form of a section of a cone) and tapers in a direction 62.

The cutting-object receptacle comprises an opening 64 which extends in the direction 62 and is bounded at one side by the edge 60. It is bounded at the other side by an edge 66.

The cutting-object receptacle 50 is oriented in such a way that the opening 64 and in particular the edge 66 or the region in the direct vicinity of the edge 66 lies on the envelope of a cone, whereby the envelope of the cone is in turn defined by the hollow cone of the cutting-object receptacle 50 (or of a sleeve cutting-object receptacle 58). A cone axis 68 of the cutting-object receptacle 50 (FIG. 3) is inclined to the edge 60, whereby the angle is the vertex angle of the cone.

Figure 8:
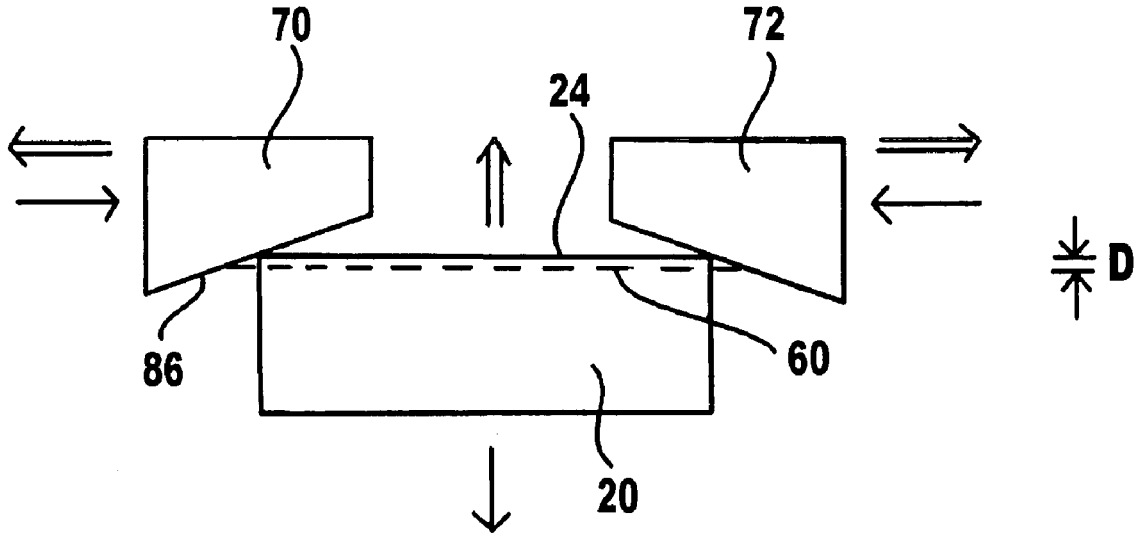
FIG. 8 a schematic illustration of the relative degree of movement of a blade and of contact elements in an embodiment of a peg cutter in accordance with the invention.

The amount by which the respective cutting edge (the second cutting edge 24 in the exemplary embodiment depicted) projects beyond the edge 60 into the opening 64 and thus into the cutting-object receptacle 50 can be set by means of the openings 34*a*, 34*b*. The part of the cutting edge 24 projecting beyond the edge 60 determines the thickness D of a paring (FIGS. 6, 8) when cutting a peg element. This thickness D of the paring is adjustable by virtue of the positioning of the blade 20 on the contact surface 18. The thicknesses of the parings can thereby be adjusted to an accuracy in the order of magnitude of 0.01 mm.

For the purposes of defining the position of the blade 20 and thus of the cutting edge 22 or 24 that is performing the cutting action, there are provided a first contact element 70 and a second contact element 72 on which the blade 20 is adapted to be placed. The contact elements 70, 72 serve as templates.

The first contact element 70 and the second contact element 72 are each in the form of a slider, whereby the contact elements 70 and 72 are guided on a guide rail 74. The guide rail is arranged on the upper housing part 14 above the cutting-object receptacle 50. It extends in the direction 62 so that the contact elements 70 and 72 are displaceable in the direction 62 (inclusive of the opposite direction). This direction of displacement is parallel to the generatrix of the envelope of a cone.

The guide rail 74 comprises a first region 76 and a second region 78, whereby the second region 78 is arranged below the first region 76 and the first region 76 projects over the second region 78 towards the blade 20.

A first scale 80*a* and a second scale 80*b* serving as orienting means are provided on the first region 76. These scales 80*a*, 80*b* serve the purpose of enabling the respective position of the first contact element 70 and of the second contact element 72 to be marked and specified. For example, the actual position of, or a target position for the contact elements 70, 72 can be marked on the first region 76 with the aid of a marker pen.

The scales 80*a*, 80*b* can be produced by means of surface structures. For example, there are provided webs 88 which are set back with respect to the remainder of the surface.

In a variant of an embodiment, the webs protrude. A front edge 90 of the first contact element 70 can rest on such a protruding web, force thereby being necessary for moving the edge 90 over a web. Consequently, marked positions for the first contact element 70 and correspondingly for the second contact element 72 are defined which, for example, correspond to particular thicknesses for the parings. Furthermore thereby, a defined alignment between the first contact element 70 and the second contact element 72 relative to one another can also be obtained in a simple manner in order to enable, in particular, the effective cutting edge 24 to be aligned in parallel with the edge 60.

The first contact element 70 comprises a first supporting region 82 with which it can be supported on the first region 76. The first supporting region 82 is matched accordingly to the shape of the first region 76. In particular, support in the downward direction and lateral support is provided.

Furthermore, the first contact element 70 comprises a second supporting region 84 by means of which it can be supported laterally on the second region 78. The second supporting region is matched accordingly to the second region 78.

The second contact element 72 is basically of the same shape as the first contact element 70, but with an anti-symmetric orientation therewith, i.e. the second contact element 72 is in the form of a mirror-image of the first contact element 70.

The first contact element 70 comprises a contact (bearing) surface 86 for the blade 20. The blade 20 can be positioned definitively relative to the cutting-object receptacle 50 by means of the contact surfaces 86 of the first contact element 70 and the second contact element 72, and the thickness of a paring can thereby be precisely set.

The spacing of the contact surface 86 relative to the guide rail 74 or relative to the edge 60 (and hence too, to the edge 66) varies in the direction 62. This spacing reduces relative to the guide rail 74 and increases relative to the edge 60 along the length of the cutting-object receptacle 50 in the direction of the taper thereof. This is shown schematically in FIG. 8. By means of a corresponding anti-symmetrical positioning of the contact elements 70 and 72 on the guide rail 74, the amount by which the blade 20 projects beyond the edge 60 can thereby be set in dependence on the position of these contact elements 70, 72 in the direction 62, whereby the cutting edge 24 can be set in parallel with the edge 60 so that it lies on the envelope of a cone and thereat, on a generatrix thereof. The thickness D of a paring can thereby be set.

The thickness of a paring can be reduced or increased by displacement of the two contact elements 70, 72 towards one another or away from one another. It is thereby ensured that the effective cutting edge 24 lies on the envelope of a cone. For example, the ratios are set such that the thickness of the cut changes by 0.01 mm for a displacement of the contact elements 70, 72 of approx. 2 mm. This corresponds to an angular ratio of 1:20 for the contact elements 70, 72.

It is advantageous for the contact surfaces 86 of the contact elements 70, 72 to be wedge-shaped. In consequence, the monotonic tapering is also achieved.

Provision is made for the contact elements 70, 72 to be used as templates for setting the position of the blade 20 only when this position needs to be set. The contact elements 70, 72 are removed during the actual cutting process. Due to the concave construction and in particular the conical construction, a simple process for precisely positioning the blade 20 and fixing the position thereof can be achieved, whereby, after the position is fixed, the contact elements 70, 72 can be drawn outwardly so as to remove them. Due to the concave construction of the bearing surfaces 86, a locating region for the blade 20 is made available, although this only has a small surface area in order to enable the contact elements 70, 72 to be removed.

The bearing surfaces 86 of the first contact element 70 and of the second contact element 72 are formed in such a way that the bevelled surfaces 26 or 28 of the effective cutting edge 22 or 24 are adapted to be placed thereon, but without making contact with the respective cutting edge 22, 24.

The sleeves 52, 54, 56 are each provided with an opening 92 which lies on the envelope of a cone and into which the blade 20 can enter.

The respective sleeves 52, 54, 56 are insertible into the cutting-object receptacle 50, whereby the sleeve cutting-object receptacles 58 have different geometrical dimensions. Different sleeves have different cone angles (vertex angles) and/or bases of different cross sectional area.

An envelope of the sleeves 52, 54, 56 is in the form of a section of a cone. In consequence, the corresponding sleeves 52, 54, 56 can only be slid up to a certain point in the direction 62. Further displacement is blocked.

Figure 1:
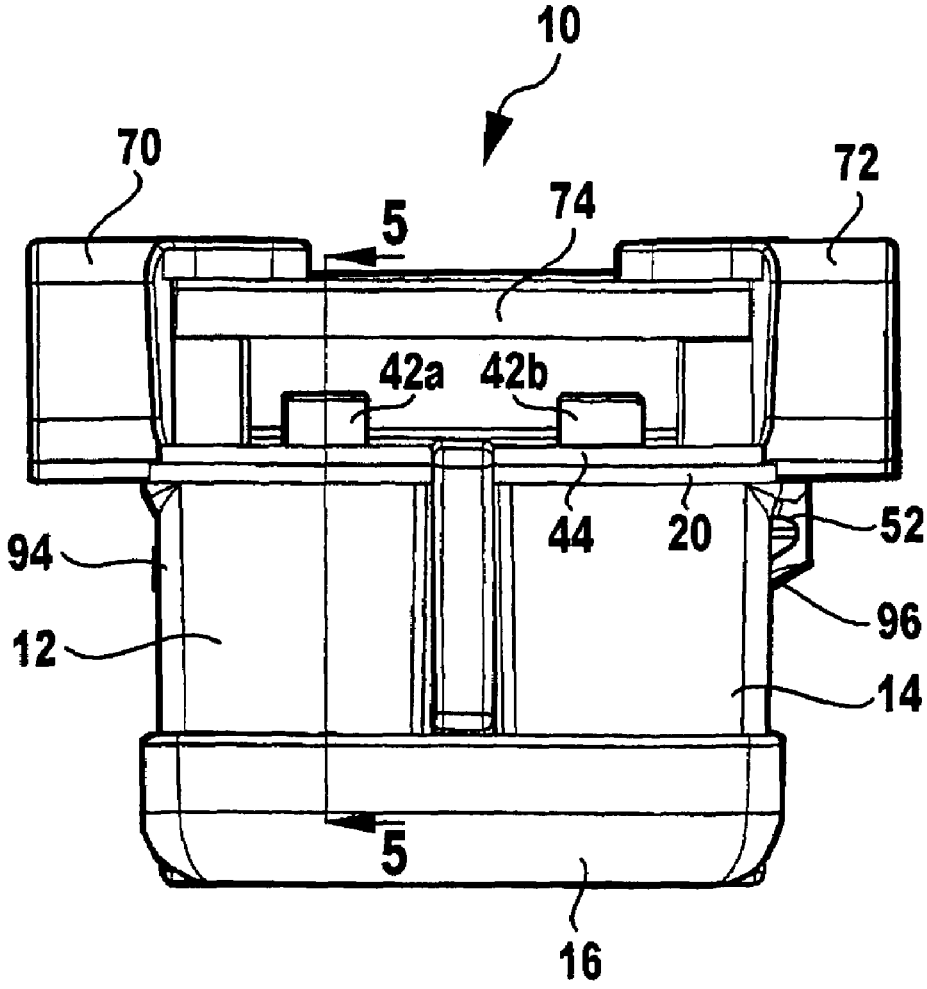
FIG. 1 shows a side view of an exemplary embodiment of a peg cutter in accordance with the invention.
Figure 2:
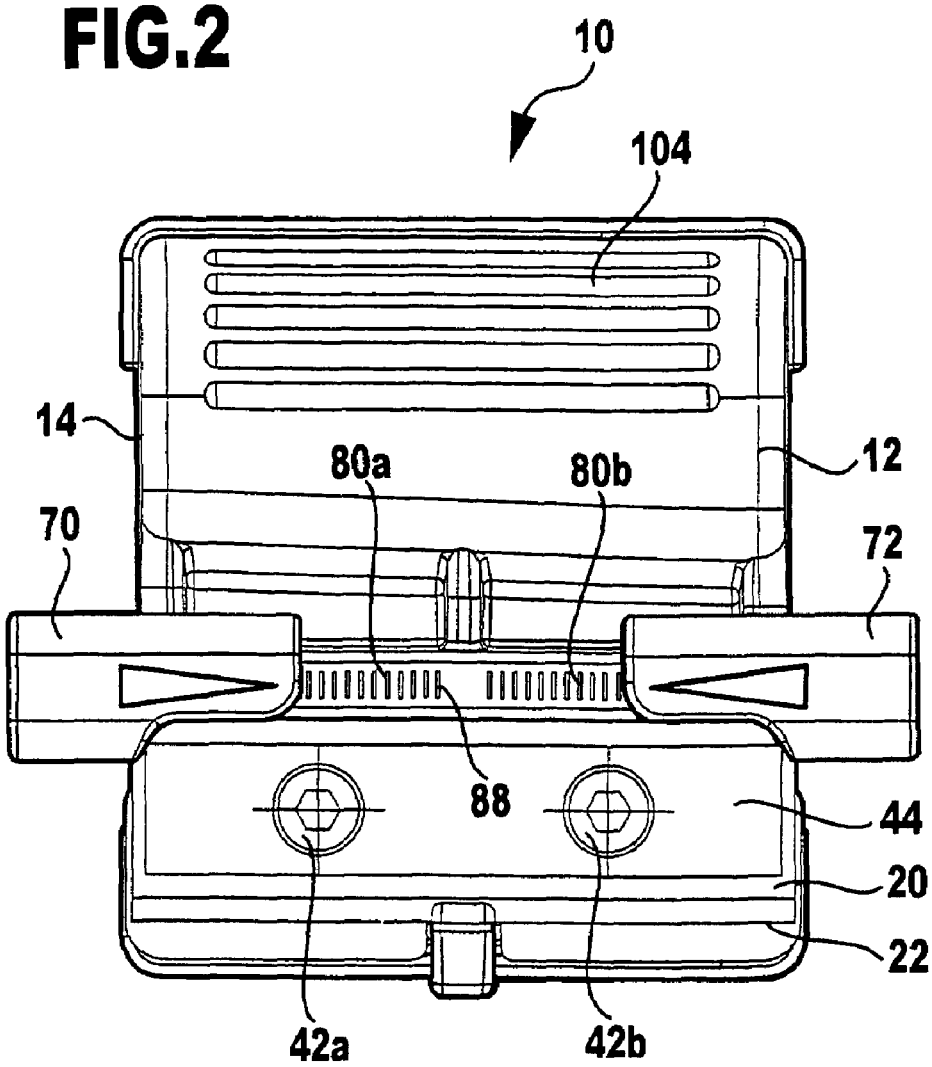
FIG. 2 a plan view of the peg cutter in accordance with FIG. 1.
Figure 3:
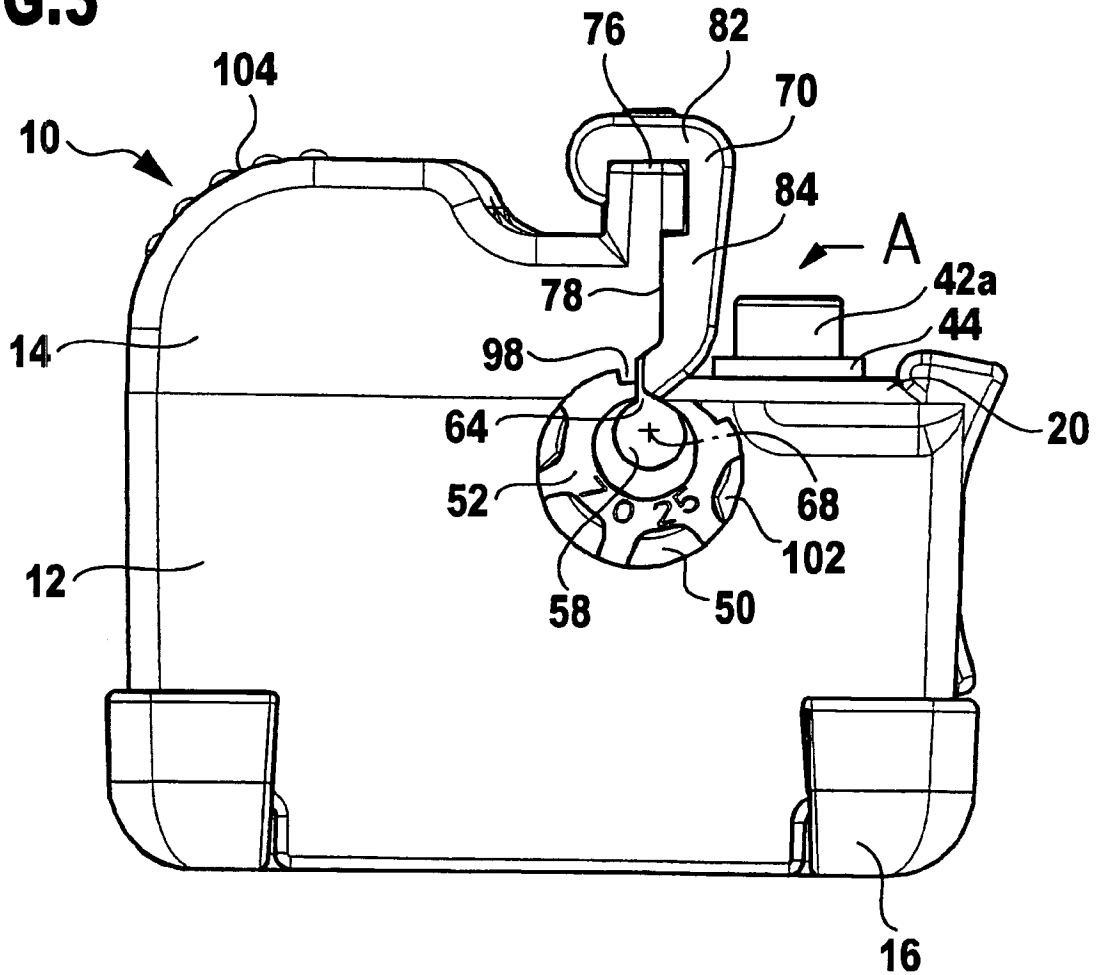
FIG. 3 a front view of the peg cutter in accordance with FIG. 1.
Figure 4:
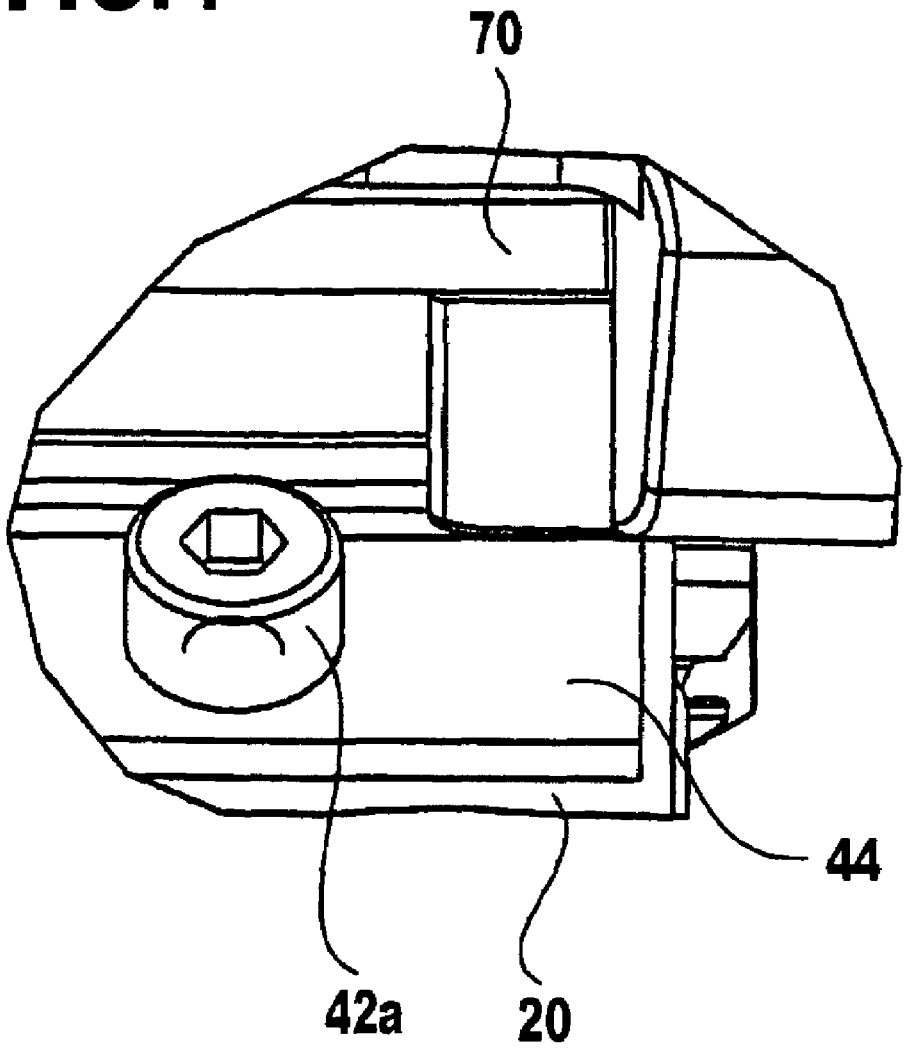
FIG. 4 an enlarged view of the region A in accordance with FIG. 3 in the form of a plan view.

In particular, the sleeves 52, 54, 56 are formed in such a way that, when in the inserted state, they are flush with the housing 12 at an inlet opening 94 (FIG. 1) through which the peg element that is to be cut is inserted, and project out from the housing 12 at the other side 96 (FIG. 1). Consequently, an inserted sleeve 52 can be removed in a simple manner by exerting pressure on the protruding end.

The sleeves 52, 54, 56 are provided with grooves 98 which form a means for preventing rotation. The grooves 98 are adapted to be placed on corresponding meshing elements 100 in the cutting-object receptacle 50 in order to prevent any tendency to rotate. Furthermore, due to the alignment between the meshing elements 100 and the groove 98, a sleeve 52, 54, 56 can be aligned in a defined manner when it is inserted so that the respective opening 92 is correctly positioned.

The sleeves 52, 54, 56 comprise further grooves 102 which serve to prevent them being fitted in the cutting-object receptacle 50 over their entire surface area.

The sleeve cutting-object receptacles 58 of the respective sleeves 52, 54, 56 are likewise aligned in such a way that the effective cutting edge 22, 24 lies on the envelope of a cone when the sleeve is positioned in the cutting-object receptacle 50. In corresponding manner, a cone axis of a sleeve cutting-object receptacle 58 is positioned at an angle to the edge 66, whereby this angle is the cone angle of the cone.

By providing a set of sleeves 52, 54, 56 each incorporating a respective sleeve cutting-object receptacle 58, the usual types of peg element can be cut with the aid of the peg cutter 10.

The upper housing part 14 of the housing 12 is provided with a handle portion 104 with which an operator can hold the peg cutter 10 in one hand whilst working on a peg element.

The peg cutter 10 in accordance with the invention functions as follows:

The contact elements 70 and 72 are positioned for the purposes of positioning the effective cutting edge 24 relative to the edge 66 and thus for setting the thickness D of a paring. For example, the contact elements 70, 72 are firstly positioned on the guide rail 74, namely, in such a manner that they are mutually mirror-symmetrical. Then, a degree of movement for the blade 20 is made possible by opening the pin elements 38*a*, 38*b* so as to decrease the pressure exerted by the retaining heads 42*a*, 42*b* on the pressure strip 44 and thus on the blade 20. The pin elements 38*a*, 38*b* are opened by means of Allen keys for example, whereby the retaining heads 42*a*, 42*b* comprise appropriate recesses. Due to the mirror-symmetrical alignment of the two-contact elements 70, 72 and the positioning of the blade 20 on the respective contact surfaces of these contact elements 70 and 72, it is ensured that the effective cutting edge 24 lies on the envelope of a cone.

Subsequently, the blade 20 is fixed and the contact elements 70 and 72 are removed and a peg element can be cut.

A peg element of particular geometrical dimensions can be cut by using an appropriate sleeve 52, 54, 56.

If the contact elements 70, 72 are pushed towards one another, then the thickness of the paring is reduced. If the contact elements 70, 72 are pushed apart, then the thickness D of the paring is increased. This is shown schematically in FIG. 8. This is made possible by virtue of the inclined and in particular conical formation of the contact surfaces 86.

In the solution in accordance with the invention, the blade 20 is adjustable so that, in particular, different thicknesses for the parings can be set. In principle, all kinds of peg elements can be pared by the provision of a set of sleeves.

Due to the alignment of the blade 20 with its effective cutting edge on the envelope of a cone and in particular on a generatrix thereof, it is ensured that an accurately cut cone for the corresponding peg element will be obtained for any arbitrary peg element. The positioning of the effective cutting edge 24 of the blade 20 relative to the peg element is always the same, irrespective of the sleeve 52 that is being used or by how much the diameter of the peg element has already been pared. Once it has been preselected, the thickness D of a paring does not change and the rake angle and the clearance angle also do not change.

In the exemplary embodiment described above, the contact elements 70 and 72 are capable of being displaced along the guide rail 74 in the direction 62, whereby the spacing of the bearing surfaces 86 varies in order to enable the thickness of a paring to be set. The direction 62 is a direction which is substantially parallel to a generatrix of the envelope of a cone.

Figure 9:
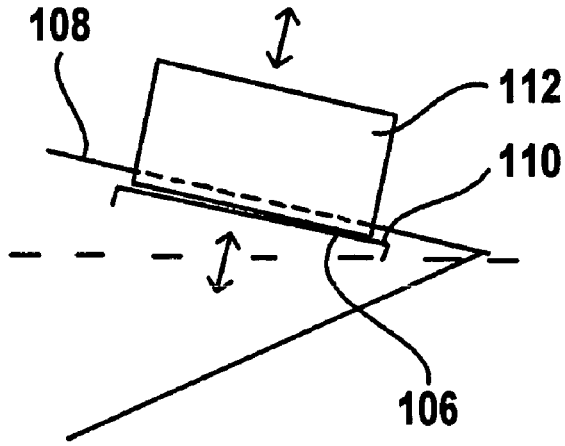
FIG. 9 an illustration of the relative degree of movement of the blade and the contact element in a further embodiment of a peg cutter in accordance with the invention.

In principle, it is also possible for a contact element 106 to be displaceable in a direction perpendicular to a generatrix 108 of the envelope of the cone as is indicated in FIG. 9, whereby a contact surface 110 of the contact element 106 must be aligned parallel to this generatrix 108. This can be achieved with the aid of appropriate setting means. If a blade 112 rests on the contact surface 110, then the cutting edge is on the envelope of a cone, so that it is ensured that an accurate cone (actually, a section of a cone) is cut.

The invention claimed is:

1. A peg cutter for peg elements of stringed musical instruments, comprising:

a housing having a bearing surface with an edge;

a blade resting on the bearing surface and having at least one cutting edge;

a cutting-object receptacle for accommodating a peg element to be cut; and at least one contact element having at least one contact surface for the blade at or in proximity to the least one cutting edge;

wherein:

said cutting-object receptacle is provided in one of the housing or in a sleeve arranged in the housing;

said cutting object receptacle is in the form of a cone with a cone axis inclined with respect to the edge of the bearing surface;

said cutting object receptacle has an opening bound by the edge of the bearing surface;

the at least one cutting edge of the blade projects beyond the edge of the bearing surface into the opening, a position of the at least one cutting edge of the blade with respect to the edge of the bearing surface is adjustable;

the at least one contact element is adapted to be fixed on the housing for adjusting the position of the at least one cutting edge of the blade and removed before a cutting operation;

the at least one contact element defines the position of the at least one cutting edge relative to the edge of the bearing surface of the cutting-object receptacle;

the at least one contact element is formed in such a way that the at least one cutting edge lies at an envelope of the cone when the blade contacts the at least one contact element.

2. A peg cutter in accordance with claim 1, wherein a thickness of a paring is adjustable by adjusting the position of the cutting edge of the blade.

3. A peg cutter in accordance with claim 2, wherein the thickness of the paring is adjustable in a range of hundredths of a millimeter.

4. A peg cutter in accordance with claim 1, wherein the at least one contact element is in the form of at least one slider for said adjusting of the position of the cutting edge of the blade.

5. A peg cutter in accordance with claim 4, further comprising a guide rail, said at least one slider being displaceable on said guide rail.

6. A peg cutter in accordance with claim 5, wherein the position of the at least one cutting edge relative to the edge of the bearing surface of the cutting-object receptacle is determined by a position of the at least one slider on the guide rail when the blade rests on the at least one slider.

7. A peg cutter in accordance with claim 5, wherein a first slider and a second slider are displaceable on the guide rail.

8. A peg cutter in accordance with claim 7, wherein the first slider and the second slider are mutually mirror symmetrical at least in respect of their contact surfaces for the blade.

9. A peg cutter in accordance with claim 4, wherein the at least one slider is displaceable on the guide rail in a direction which is substantially parallel to the envelope of the cone.

10. A peg cutter in accordance with claim 5, wherein the at least one contact surface for the blade has a varying spacing in a direction transverse to the guide rail.

11. A peg cutter in accordance with claim 10, wherein the at least one slider tapers monotonically in one direction.

12. A peg cutter in accordance with claim 9, wherein the at least one contact surface is wedge-shaped.

13. A peg cutter in accordance with claim 1, wherein the at least one blade is beveled with respect to the at least one cutting edge and has at least one corresponding beveled surface.

14. A peg cutter in accordance with claim 13, wherein the at least one contact element is adapted to contact the at least one corresponding beveled surface without contacting the cutting edge.

15. A peg cutter in accordance with claim 1, wherein a cross section of the cutting-object receptacle tapers towards one side.

16. A peg cutter in accordance with claim 1, wherein the cutting-object receptacle in the form of a cone comprises a hollow truncated cone.

17. A peg cutter in accordance with claim 1, wherein:

the cutting-object receptacle is provided in the sleeve arranged in the housing;

the sleeve is removable from the housing; and at least two sleeves with differently sized cutting-object receptacles are provided.

18. A peg cutter in accordance with claim 17, wherein the sleeve or sleeves are fixable in the housing in a non-rotatable manner.

19. A peg cutter in accordance with claim 17, wherein the sleeve is in the form of a hollow truncated cone.

20. A peg cutter in accordance with claim 17, wherein the opening is arranged towards the at least one contact element.

21. A peg cutter in accordance with claim 20, wherein the opening lies on the envelope of the cone when the corresponding sleeve is positioned in the housing.

22. A peg cutter in accordance with claim 17, wherein a set of said sleeves with differently sized cutting-object receptacles are provided.

23. A peg cutter in accordance with claim 1, wherein the axis of the cone is inclined to the cutting edge by a cone angle when the cutting edge is adjusted.

24. A peg cutter in accordance with claim 1, wherein the at least one contact element is displaceable perpendicularly to the envelope of the cone.

* * * * *